US005620779A

United States Patent [19]

Levy et al.

[11] Patent Number: 5,620,779

[45] Date of Patent: Apr. 15, 1997

[54] RIBBED CLOTHLIKE NONWOVEN FABRIC

[75] Inventors: Ruth L. Levy, Sugar Hill; Ann L. McCormack, Cumming, both of Ga.

[73] Assignee: Kimberly-Clark Corporation, Neenah, Wis.

[21] Appl. No.: 622,493

[22] Filed: Mar. 25, 1996

Related U.S. Application Data

[63] Continuation of Ser. No. 172,339, Dec. 23, 1993, abandoned.

[51] Int. Cl.[6] ..... B05D 5/06

[52] U.S. Cl. ..... 428/167; 428/198; 428/219

[58] Field of Search ..... 428/167, 198, 428/219, 296

[56] References Cited

U.S. PATENT DOCUMENTS

| | | | |
|---|---|---|---|
| D. 239,566 | 4/1976 | Vogt | D59/2 R |
| 3,214,323 | 10/1965 | Russell et al. | 161/148 |
| 3,310,454 | 3/1967 | Florio et al. | 161/123 |
| 3,692,618 | 9/1972 | Dorschner et al. | 161/72 |
| 3,733,234 | 5/1973 | Dunning | 156/209 |
| 3,849,241 | 11/1974 | Butin et al. | 161/169 |
| 3,855,046 | 12/1974 | Hansen et al. | 161/150 |
| 3,949,128 | 4/1976 | Ostermeier | 428/152 |
| 4,041,203 | 8/1977 | Brock et al. | 428/157 |
| 4,107,364 | 8/1978 | Sisson | 428/196 |
| 4,154,885 | 5/1979 | Tecl et al. | 428/198 |
| 4,170,680 | 10/1979 | Cumbers | 428/195 |
| 4,187,343 | 2/1980 | Akiyama et al. | 428/288 |
| 4,307,143 | 12/1981 | Meitner | 252/91 |
| 4,340,563 | 7/1982 | Appel et al. | 264/518 |
| 4,443,513 | 4/1984 | Meitner et al. | 422/195 |
| 4,659,614 | 4/1987 | Vitale | 428/218 |
| 4,965,122 | 10/1990 | Morman | 428/225 |
| 4,981,747 | 1/1991 | Morman | 428/198 |
| 5,114,781 | 5/1992 | Morman | 428/198 |
| 5,169,706 | 12/1992 | Collier, IV et al. | 428/152 |
| 5,296,289 | 3/1994 | Collins | 428/296 |

FOREIGN PATENT DOCUMENTS

| | | | |
|---|---|---|---|
| 977530 | 11/1975 | Canada . | |
| 0236091 | 9/1987 | European Pat. Off. | D04H 3/16 |
| 1558401 | 1/1980 | United Kingdom | D04H 1/62 |

*Primary Examiner*—Christopher Raimund
*Attorney, Agent, or Firm*—James B. Robinson

[57] ABSTRACT

There is provided herein a ribbed clothlike nonwoven fabric made by a method comprising the steps of providing a nonwoven web of thermoplastic polymer of staple length or longer fibers or filaments having a pattern of fused bond areas wherein the pattern has at least one space and at least one unit width, as defined herein, in a ratio of at least 0.30, and then extending the web up to less than the breaking point of the fibers or filaments in at least one direction. The product which is thereby produced is a ribbed clothlike nonwoven fabric comprising a web of thermoplastic polymer of staple length or longer fibers or filaments having a pattern of fused bond areas wherein the pattern has space and unit width in a ratio of at least 0.30, and wherein the fabric has been extended up to less than the breaking point of the fibers or filaments in at least one direction so as to produce ribs.

The stretching may be accompanied by heating by methods known in the art to a temperature ranging from greater than the polymer's alpha-transition temperature to about 10 percent below the onset of melting at a liquid fraction of 5 percent.

10 Claims, 10 Drawing Sheets

Staggered pattern allows no machine direction spaces

Space/Unit Width = ~14 to 26%

Space (S)/Unit Width (W) = ~50%

Space $S_1 = S_2$
Space /Unit Width $W_1$ = ~50%
Space/Unit Width $W_2$ = ~70%

Space (S)/Unit Width (W) = [illegible]%

Space(S)/Unit Width (W) = ~45%

Space (S)/Unit Width (W) = ~40%

Space $S_1 = S_2$
Space/Unit Width $W_1$ = ~21%
Space/Unit Width $W_2$ = ~50%

RIBBED CLOTHLIKE NONWOVEN FABRIC

This application is a continuation of application Ser. No. 08/172,339 entitled "RIBBED CLOTHLIKE NONWOVEN FABRIC AND PROCESS FOR MAKING SAME" and filed in the U.S. Patent and Trademark Office on Dec. 23, 1992, now abandoned. The entirety of this application is hereby incorporated by reference.

BACKGROUND OF THE INVENTION

This invention relates to the field of nonwoven fabrics for durable or non-durable use.

Nonwoven fabrics have been produced by a number of processes for a number of decades. Their uses have been many, for example as components of diapers, disposable wipes, feminine hygiene products, surgical gowns and drapes, industrial wipes, oil spill cleanup materials and even applications in the furniture and apparel markets.

A disadvantage that nonwoven fabrics have had in applications as apparel has been that nonwoven fabrics have not exhibited a clothlike feel, stretch or visual aesthetic similar to woven or knitted fabrics. Nonwoven fabrics have generally been point bonded in such a way as to be relatively flat and visually unattractive and to have a relatively rough hand when compared to more expensive textiles.

A number of treatments have been developed to soften nonwoven fabrics such as multiple washings, chemical treatments, or stretching. While these techniques have been successful in softening nonwoven fabrics somewhat, none has proven completely satisfactory for the apparel market.

Accordingly, it is an object of this invention to provide a nonwoven fabric with a clothlike feel, stretch and visual appeal.

SUMMARY

There is provided herein, in order to satisfy the objects of the invention, a method of producing a ribbed clothlike nonwoven fabric comprising the steps of providing a nonwoven web of thermoplastic polymer staple length or longer fibers or filaments having a pattern of fused bond areas wherein the pattern has space and unit width, as defined herein, in a ratio of at least 0.30, and then extending the web up to less than the breaking point of the fibers or filaments in at least one direction. The product which is thereby produced is a ribbed clothlike nonwoven fabric comprising a web of thermoplastic polymer of staple length or longer fibers or filaments having a pattern of fused bond areas wherein the pattern has space and unit width in a ratio of at least 0.30, and wherein the fabric has been extended up to less than the breaking point of the fibers or filaments in at least one direction so as to produce ribs.

The stretching may be accompanied by heating by methods known in the art to a temperature ranging from greater than the polymer's alpha-transition temperature to about 10 percent below the onset of melting at a liquid fraction of 5 percent.

DEFINITIONS

Figure 1:
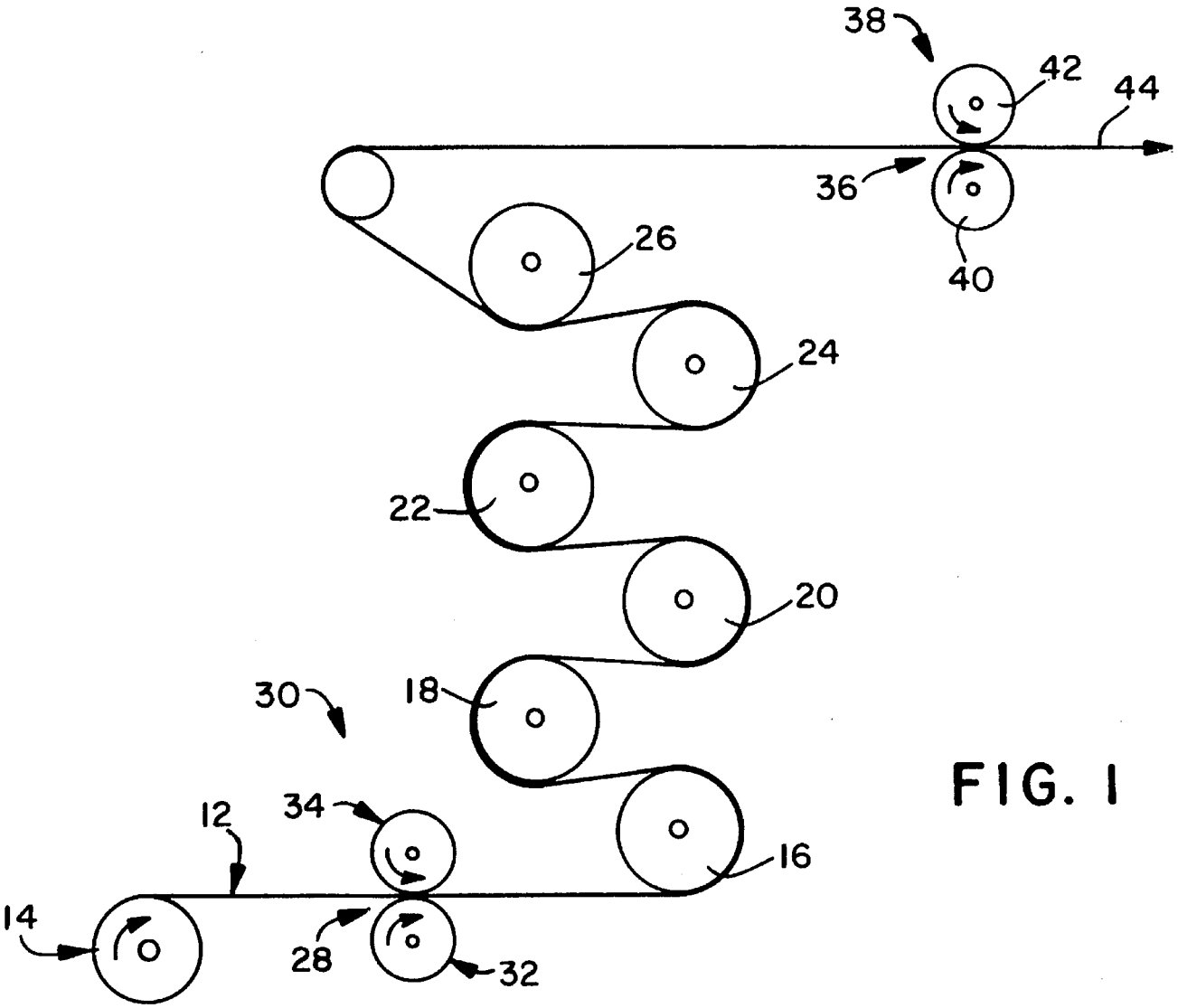
FIG. 1 is an illustration of a process of treating a nonwoven fabric.

As used herein the term "nonwoven fabric or web" means a web having a structure of individual fibers, filaments or threads which are interlaid, but not in an identifiable manner. Nonwoven fabrics or webs have been formed from many processes such as for example, meltblowing processes, spunbonding processes, and bonded carded web processes.

As used herein the term "microfibers" means small diameter fibers having an average diameter not greater than about 100 microns, for example, having an average diameter of from about 0.5 microns to about 50 microns, or more particularly, microfibers may desirably have an average diameter of from about 2 microns to about 40 microns.

As used herein the term "meltblown fibers" means fibers formed by extruding a molten thermoplastic material through a plurality of fine, usually circular, die capillaries as molten threads or filaments into a high velocity, usually heated gas (e.g. air) stream which attenuates the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin.

As used herein the term "spunbonded fibers" refers to small diameter fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al.

As used herein the term "machine direction" refers to the direction of formation of the meltblown or spunbond web. Since such webs are generally extruded onto a moving conveyor belt or "forming wire", the direction of formation of such webs (the machine direction) is the direction of movement of the forming wire. The terms "cross direction" and "cross machine direction" mean a direction which is substantially perpendicular to the machine direction.

As used herein the term "bicomponent" refers to fibers which have been formed from at least two polymers extruded from separate extruders but spun together to form one fiber. The configuration of such a bicomponent fiber may be, for example, a sheath/core arrangement wherein one polymer is surrounded by another or may be a side by side arrangement.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic, syndiotactic and random symmetries.

As used herein the term "recover" refers to a contraction of a stretched material upon termination of a biasing force following stretching of the material by application of the biasing force. For example, if a material having a relaxed, unbiased length of one (1) inch was elongated 50 percent by stretching to a length of one and one half (1.5) inches the material would have been elongated 50 percent and would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein, the terms "necking" or "neck stretching" interchangeably refer to a method of elongating a nonwoven fabric, generally in the machine direction, to reduce its width in a controlled manner to a desired amount. The controlled stretching may take place under cool, room temperature or greater temperatures and is limited to an increase in overall dimension in the direction being stretched up to the elongation required to break the fabric, which in most cases is about 1.2 to 1.4 times. Such processes are disclosed, for example, in U.S. Pat. No. 4,443,513 to Meitner and Notheis, U.S. Pat. No. 4,965,122 to Morman and U.S. Pat. No. 5,320,891 which are hereby incorporated by reference.

As used herein the term "unit width" refers to the distance from the beginning of a column of bond points to the beginning of the next nearest column of bond points as measured in the cross machine direction. Such a measurement will necessarily include the width of one discrete column of bond points and the width of the unbonded distance between the included column of bond points and the next column of bond points. The term "space" refers to the width of the unbonded area between the two neighboring columns of bond points.

As used herein, the term "rib" means a raised ridge, cord or wale in a fabric. An example of ribbing is the parallel ridges in the surface of a fabric such as corduroy.

As used herein, the term "garment" means any type of apparel which may be worn. This includes diapers, training pants, incontinence products, surgical gowns, industrial workwear and coveralls, undergarments, pants, shirts, jackets and the like.

DETAILED DESCRIPTION OF THE INVENTION

The field of nonwoven fabrics is a diverse one encompassing absorbent products such as diapers, wipes and feminine hygiene products and barrier products such as surgical gowns and drapes, car covers, and bandages. Nonwovens are also used for more durable applications such as apparel, though the visual aesthetics, stretch and the feel of nonwovens has limited the acceptance of nonwovens in this area.

A product and a process for producing the product have been developed which yield a stretchable clothlike ribbed nonwoven fabric which is quite similar to woven or knit materials.

The fibers from which the fabric of this invention is made may be produced by the meltblowing or spunbonding processes which are well known in the art. These processes generally use an extruder to supply melted thermoplastic polymer to a spinnerette where the polymer is fiberized and yield fibers which may be staple length or longer. The fibers are then drawn, usually pneumatically, and deposited on a foraminous mat or belt to form the nonwoven fabric. The fibers produced in the spunbond and meltblown processes are microfibers as defined above.

The fabric used in the process of this invention may be a single layer embodiment or a multilayer laminate. Such a multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 6 to about 400 grams per square meter. The process of this invention may also produce fabric which has been laminated with films, glass fibers, staple fibers, paper, and other web materials.

Nonwoven fabrics are generally bonded in some manner as they are produced in order to give them sufficient structural integrity to withstand the rigors of further processing into a finished product. Bonding can be accomplished in a number of ways such as hydroentanglement, needling, ultrasonic bonding, adhesive bonding and thermal bonding. Thermal bonding is the method preferred in this invention.

Thermal bonding of a nonwoven may be accomplished by passing the nonwoven fabric between the rolls of a calendering machine. At least one of the rollers of the calender is heated and at least one of the rollers, not necessarily the same one as the heated one, has a pattern which is imprinted upon the nonwoven fabric as it passes between the rollers. As the fabric passes between the rollers it is subjected to pressure as well as heat. The combination of heat and pressure applied in a particular pattern results in the creation of fused bond areas in the nonwoven fabric where the bonds on the fabric correspond to the pattern of bond points on the calender roll.

The exact calender temperature and pressure for bonding the nonwoven web depend on thermoplastic(s) from which the web is made. Generally for polyolefins the preferred temperatures are between 150° and 350° F. (66° and 177° C.) and the pressure between 300 and 1000 pounds per lineal inch. More particularly, for polypropylene, the preferred temperatures are between 270° and 320° F. (132° and 160° C.) and the pressure between 400 and 800 pounds per lineal inch.

The thermoplastic polymers which may be used in the practice of this invention may be any known to those skilled in the art to be commonly used in meltblowing and spunbonding. Such polymers include polyolefins, polyesters and polyamides, and mixtures thereof, more particulary polyolefins such as polyethylene, polypropylene, polybutene, ethylene copolymers, propylene copolymers and butene copolymers.

Various patterns for calender rolls have been developed. One example is the expanded Hansen Pennings pattern with about a 15% bond area with about 100 bonds/square inch as taught in U.S. Pat. No. 3,855,046 to Hansen and Pennings. Another common pattern is a diamond pattern with repeating and slightly offset diamonds.

It has been found to be critical for the formation of ribs in a nonwoven fabric, that the pattern of bonding have columns of unbonded area extending along the fabric. In a pattern of this type the bonded areas line up fairly regularly under each other through a given length of fabric and the unbonded areas do as well.

It is not necessary, however, that the bond areas line up exactly under each other through the given length of fabric, i.e. the columns need not be exactly perpendicular to the direction of stretch, just that they provide a column of open, unbonded area. Indeed, many patterns which meet the requirements of this invention are skewed at an angle of up to 5 degrees to the direction of production (the machine direction) of the nonwoven web. Such a slightly skewed though substantially perpendicular pattern is intended to be encompassed within the boundaries of this invention.

Figure 16:
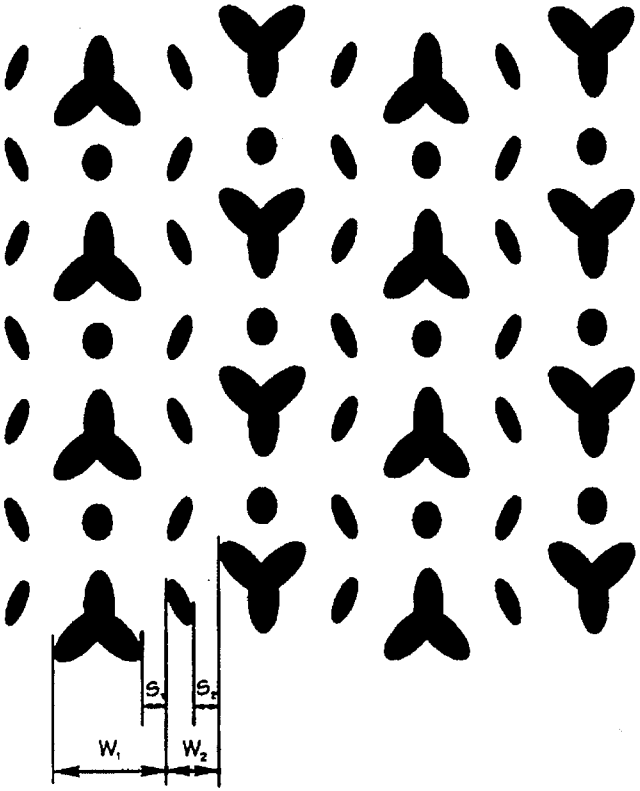

One method of defining the type of pattern necessary in the practice of this invention is to calculate the ratio of the width of open space between columns of bond points, to the distance from the beginning of one column of bond points to another (the "unit width" as defined above) in nonwoven fabrics having a columnar pattern. It has been found that the ratio of space to unit width must be at least 0.3 to practice this invention and that fabrics meeting this criterion will form ribs in the unbonded area upon stretching. Examples of such bond patterns may be found in FIGS. 12–17 where "S" refers to the width of open space between columns of bond points, and "W" refers to the distance from the beginning of one column of bond points to another (the "unit width"). It should also be noted that many patterns have more than one space and/or unit width (e.g. FIG. 16), therefore, the ratio of at least one space to at least one unit width must be at least 0.3 to practice this invention.

The diamond pattern as mentioned above provides rows of diamonds which do not line up one above the other in the machine direction. As a result the unbonded area does not form a column and such diamond bonded nonwovens do not produce a ribbed clothlike nonwoven fabric upon stretching. Such a pattern is discussed in Comparative Example 1 below.

After the nonwoven has been bonded with a pattern, it is neck stretched. Neck stretching or necking is known in the art for the purpose of softening, stretching or increasing the bulk of a nonwoven fabric. Such processes are disclosed, for example, in U.S. Pat. No. 4,443,513 to Meitner and Notheis and another in U.S. Pat. No. 4,965,122 to Morman.

Necking can be performed as the fabric is being produced or can be done as a secondary operation some time after production of the bonded nonwoven fabric. In necking, the fabric is stretched in the machine direction to a point below the breaking point of the filaments or fibers which make up the fabric. More particularly, the fabric may be stretched to up to 140% of its original length. The stretching may be accompanied by heating or may be performed at room temperature or below.

One particularly acceptable method of stretching the nonwoven web is explained in detail in U.S. Pat. No. 5,320,891 which was filed on Dec. 31, 1992. In this method, the nonwoven web is heated to a temperature ranging from greater than the polymer's alpha-transition temperature to about 10 percent below the onset of melting at a liquid fraction of 5 percent, prior to stretching. One way to roughly estimate a temperature approaching the upper limit of such heating is to multiply the polymer melt temperature (expressed in degrees Kelvin) by 0.95.

Alternatively, the nonwoven may be stretched at room temperature and then heated while stretched to "set" the stretch into the fabric (as in U.S. Pat. No. 4,965,122).

Heating of a nonwoven web may be performed by passing the web over a series of steam cans or heating by using infra-red waves, microwaves, ultrasonic energy, flame, hot gases (e.g. in an oven), hot liquids and the like.

The bonded stretched nonwoven fabric may be wound into a roll for transportation to further processing or may be used directly.

Thermal bonding with a pattern as described above and subsequent necking produce a nonwoven fabric having ribs along the columns of unbonded areas. Ribs are an important factor in creating a clothlike feel and look to a fabric.

Following is an example of the production of a ribbed clothlike nonwoven web of this invention and a comparative example of a nonwoven web not possessing clothlike attributes to as desirable a degree.

EXAMPLE 1

A spunbond/meltblown/spunbond (SMS) thermoplastic web laminate was produced having a basis weight of 1.4 ounces per square yard (osy) in accordance with the procedures described in U.S. Pat. No. 4,307,143 to Meitner et al. The laminate had a meltblown layer of 0.4 osy and spunbond layers of 0.5 osy each. This web was produced by extruding molten polypropylene from a plurality of fine, circular capillaries of a spinnerette (spunbonding) onto a forming wire to form a layer of small diameter fibers, depositing a layer of meltblown polypropylene microfibers thereon, and finally depositing another layer of spunbond polypropylene fiber over the meltblown layer.

Figure 2:
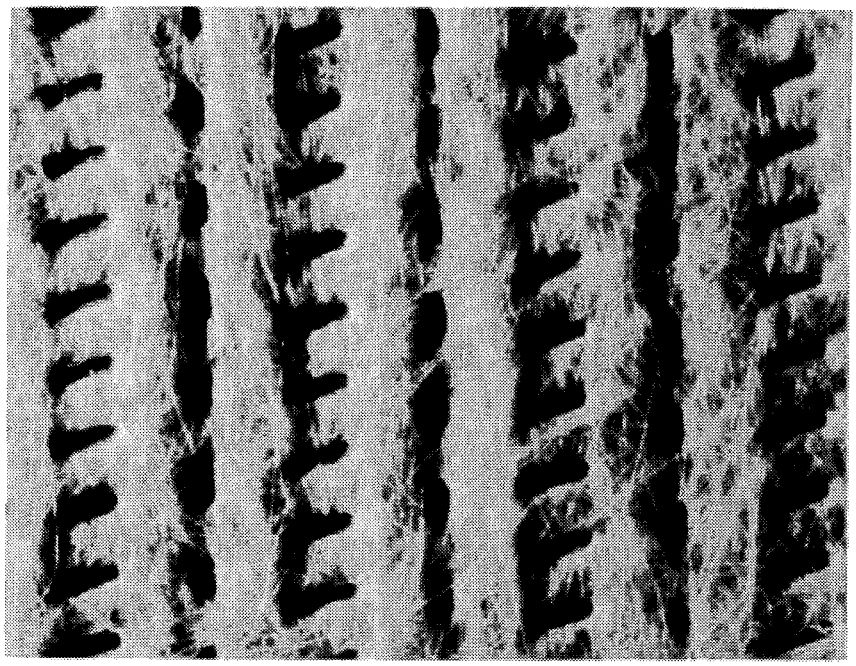
FIG. 2 is a photograph at a magnification of 7.2×, of a nonwoven fabric which has been bonded with a pattern which is in accordance with the invention.

The polypropylene used in the spunbond layers was PD9355 from the Exxon Chemical Company, Baytown, Tex. and the meltblown layer was of PD 3495G also from Exxon. The web was pattern bonded under heat and pressure conditions of 295° F. (146° C.) and 430 pounds per square inch with 20 inch (51 cm) diameter rolls in a pattern as illustrated in FIG. 2. This pattern had a bond area of about 11% with about 200 bonds/square inch.

This web was then stretched using the method illustrated in FIG. 1. As shown in FIG. 1, the nonwoven material or web 12 was unwound from a supply roll 14 and traveled in the direction indicated by the arrows associated therewith as the supply roll 14 rotated in the direction of the arrows associated therewith. The material 12 passed through the nip 28 of a roller arrangement 30 in a path as indicated by the rotation direction arrows associated with the stack rollers 32 and 34. From the roller arrangement 30, the material 12 passed over a series of heated drums (e.g., steam cans) 16–26 in a series of reverse S-loops. The steam cans 16–26 were about 24 inches (61 cm) in diameter although other sized cans may be used. The contact or residence time of the material 12 on the steam cans 16–26 was sufficient to raise the temperature of the material 12 to about 242° F. (117° C.). The heated neckable material 12 then passed through the nip 36 of a drive roller arrangement 38 formed by the drive rollers 40 and 42. Because the peripheral linear speed of the rollers of the roller arrangement 30 is controlled to be less than the peripheral linear speed of the rollers of the drive roller arrangement 38, the heated neckable material 12 was tensioned so that it necked a desired amount and was maintained in such tensioned, necked condition while it was cooled. In this example the material 12 was drawn 19% in the machine direction at a speed of 50 feet/min (15 m/min).

Figure 12:
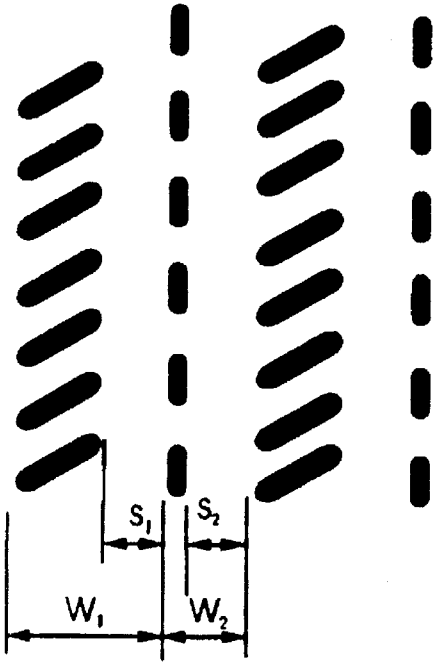
Figure 15:
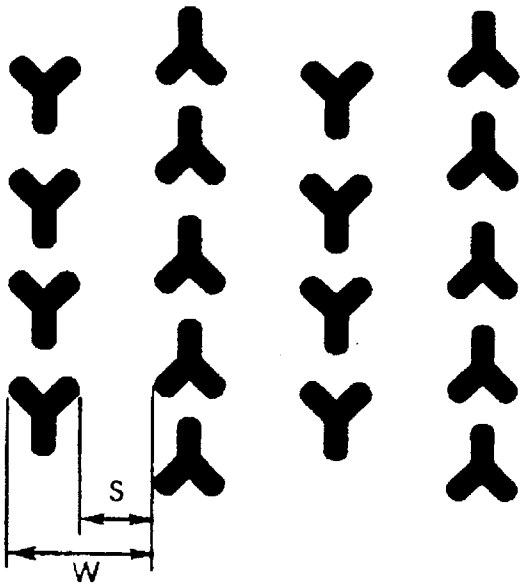
Figure 14:
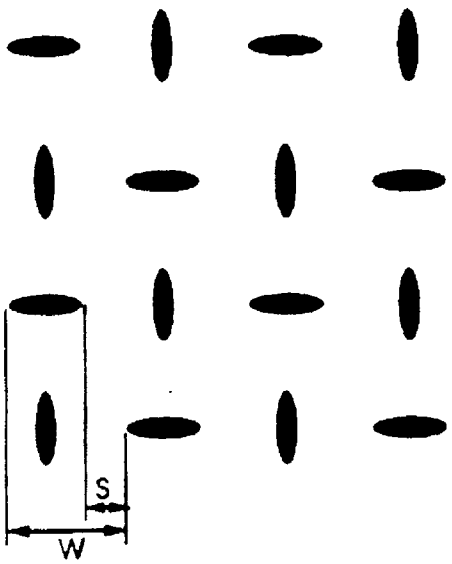
Figure 17:
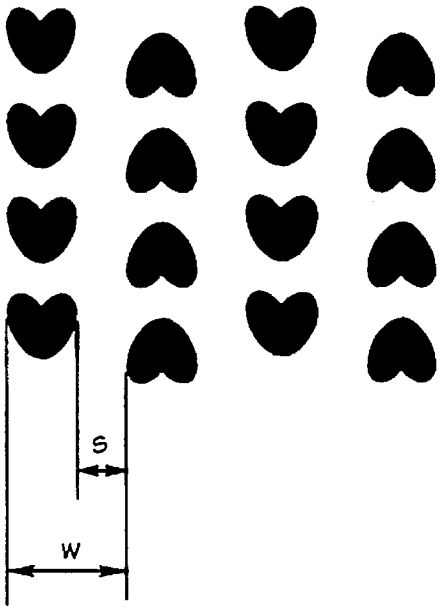

FIG. 2 shows the web of this example before stretching and FIG. 12 shows the space to unit width ratios of this pattern.

Figure 3:
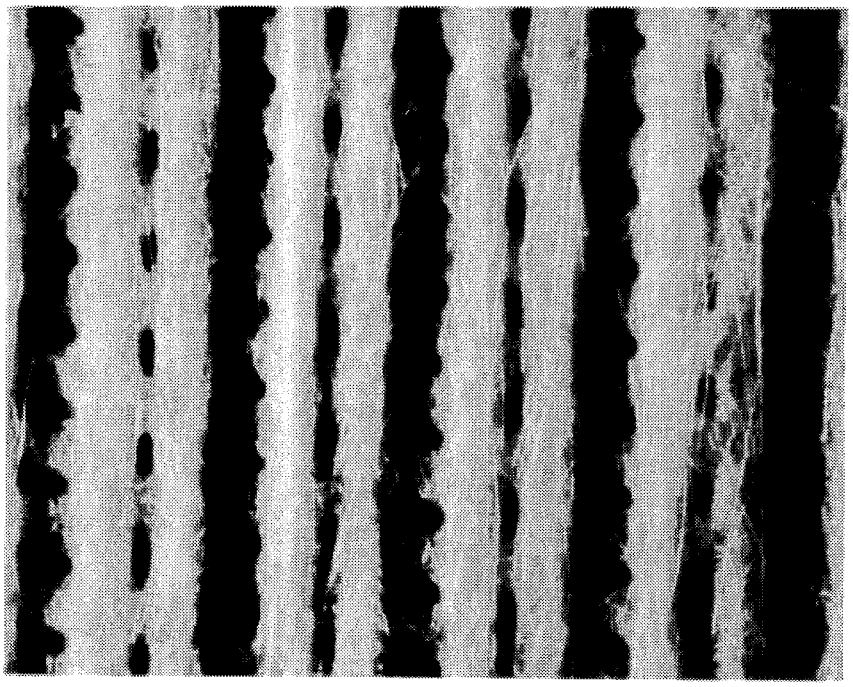
FIG. 3 is a photograph at a magnification of 7.2×, of the nonwoven fabric of FIG. 2 after stretching.
Figure 4:
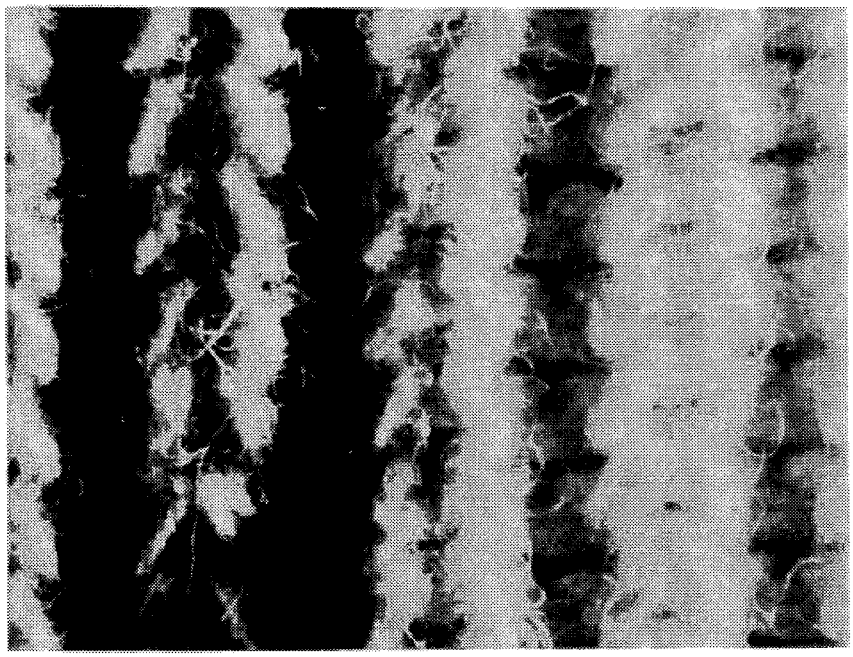
FIG. 4 is a photograph of a typical knit sweater at a magnification of 3.6×.

After stretching, the resultant bonded necked nonwoven web is shown in FIG. 3 and has a clothlike visual appearance. FIG. 4 is a photograph of a typical knit material. The clothlike visual appearance of FIG. 3 can be seen by a comparison of FIG. 3 with FIG. 4 which shows that the necked nonwoven web has the clothlike ribbing which is characteristic of a knit material.

COMPARATIVE EXAMPLE 1

A nonwoven laminate SMS web was produced according to the procedure in example 1. The polymer used in the meltblown layer was the same as example 1. The polymer used in the spunbond layers was PF 301, available from Himont Chemical Company.

Figure 5:
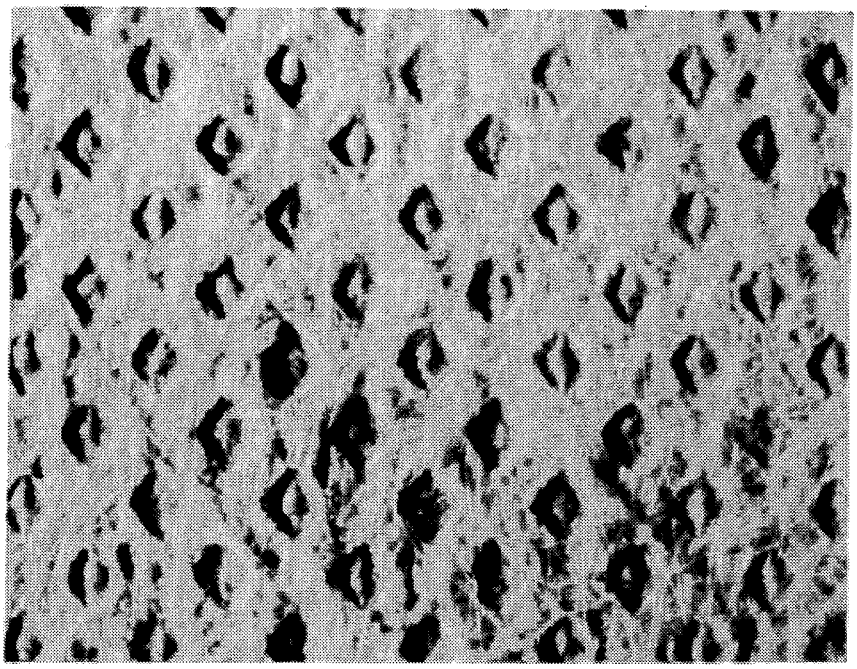
FIG. 5 is a photograph at a magnification of 7.2×, of a nonwoven fabric which has been bonded with a pattern which is not in accordance with the invention.
Figure 10:
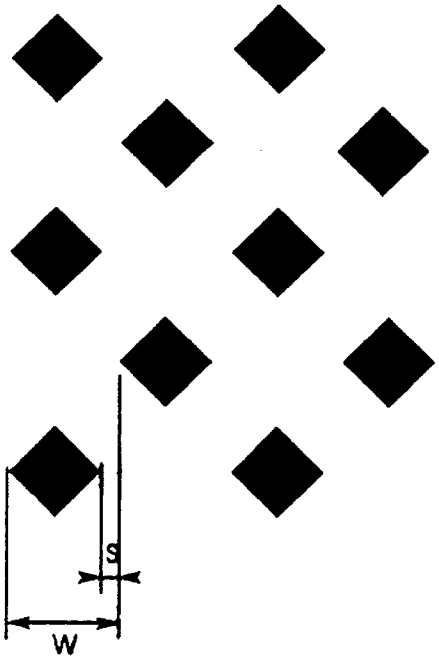
Figure 13:
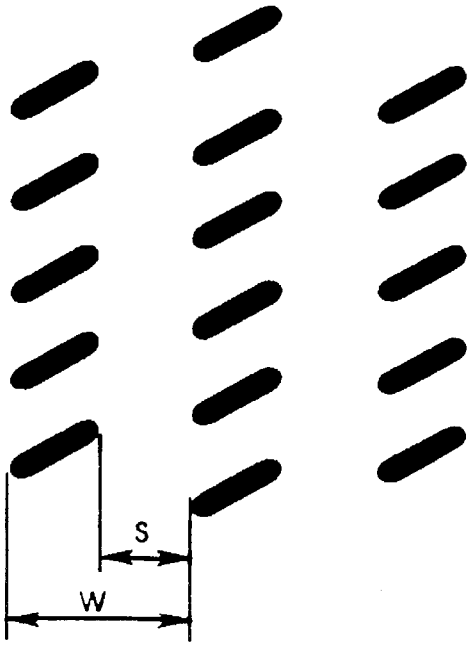
FIGS. 12 through 17 are illustrations of bonding patterns which are in accordance with the invention.

The bonding pattern was a diamond pattern as pictured in FIG. 5 prior to stretching. This pattern has about 15% bond area with about 200 bonds/square inch with a repeating pattern of bonded and unbonded area arranged in such a way as to provide columns of bonded area next to columns of unbonded area wherein the ratio of space to unit width is less than 0.3. This pattern is also shown in FIG. 10.

Figure 6:
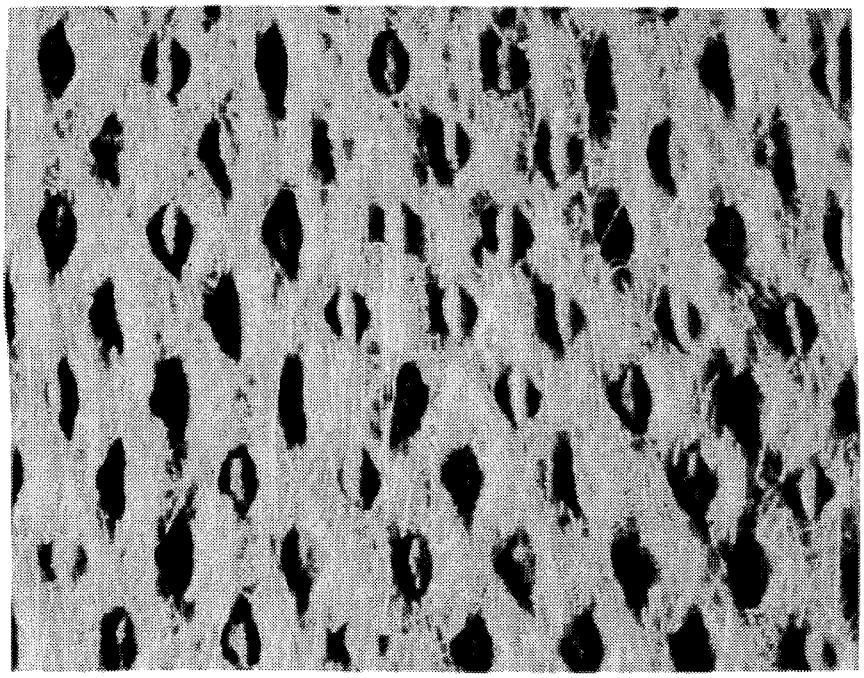
FIG. 6 is a photograph at a magnification of 7.2×, of the nonwoven fabric of FIG. 5 after stretching.

The diamond bonded SMS web was stretched in the manner described in example 1. The resultant neck stretched diamond bonded SMS web is shown in FIG. 6. As can be seen from the FIG. 6, the web does not have the clothlike visual appearance of that of Example 1 as shown in FIG. 3.

EXAMPLE 2

A spunbond/meltblown/spunbond (SMS) thermoplastic web laminate was produced and stretched according to the procedure of Example 1. The same polymers as in Example 1 were used, the only difference being that the meltblown layer had a basis weight of 0.5 osy, producing a total laminate basis weight of 1.5 osy. The bonding pattern was that shown in FIG. 14 and known as "wire weave". This pattern has a space to unit width ratio of about 0.45 or 45% with a bond area of about 15% and about 300 bonds/square inch.

Figure 7:
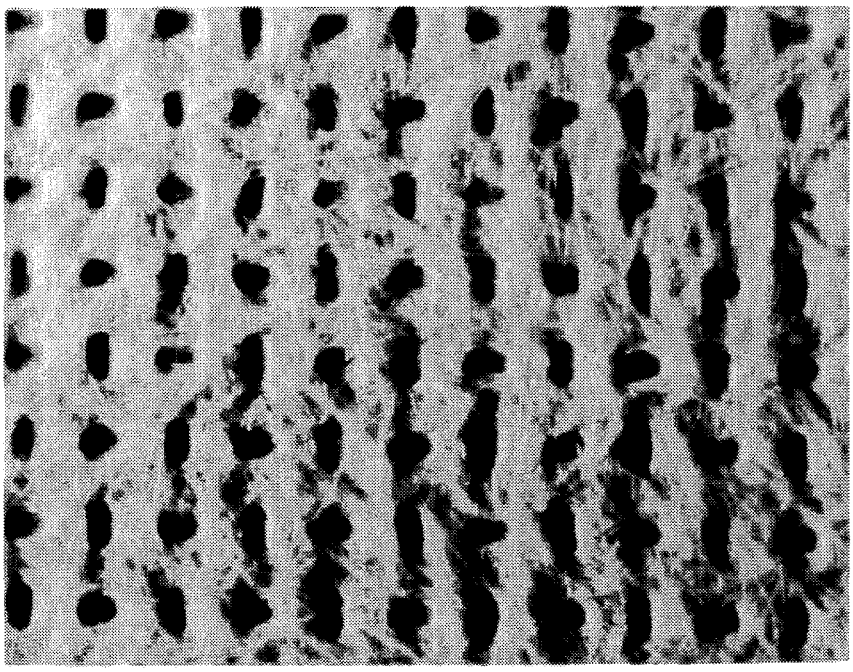
FIG. 7 is a photograph at a magnification of 7.2×, of a nonwoven fabric which has been bonded with a pattern which is in accordance with the invention.
Figure 8:
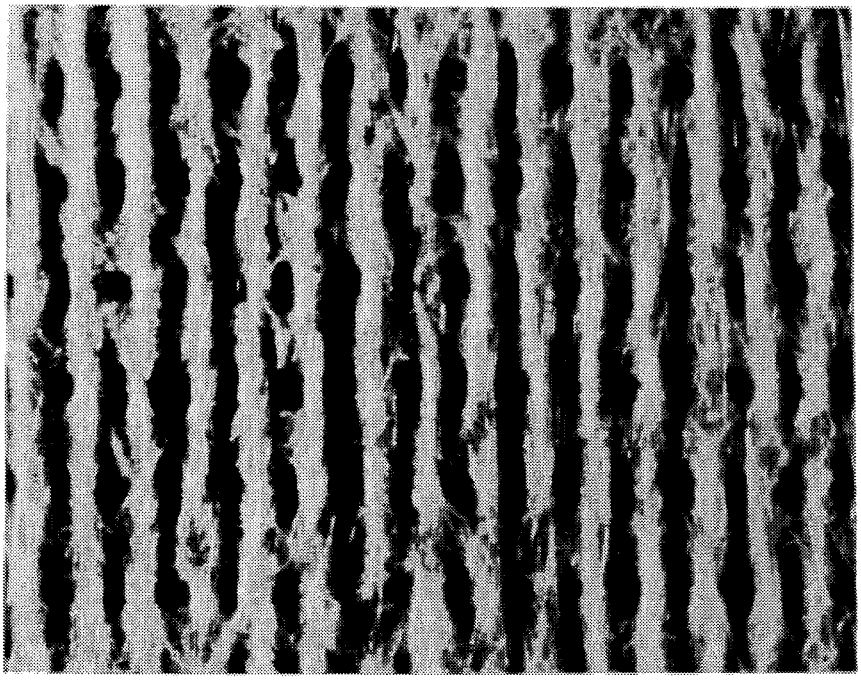
FIG. 8 is a photograph at a magnification of 7.2×, of the nonwoven fabric of FIG. 7 after stretching.
Figure 9:
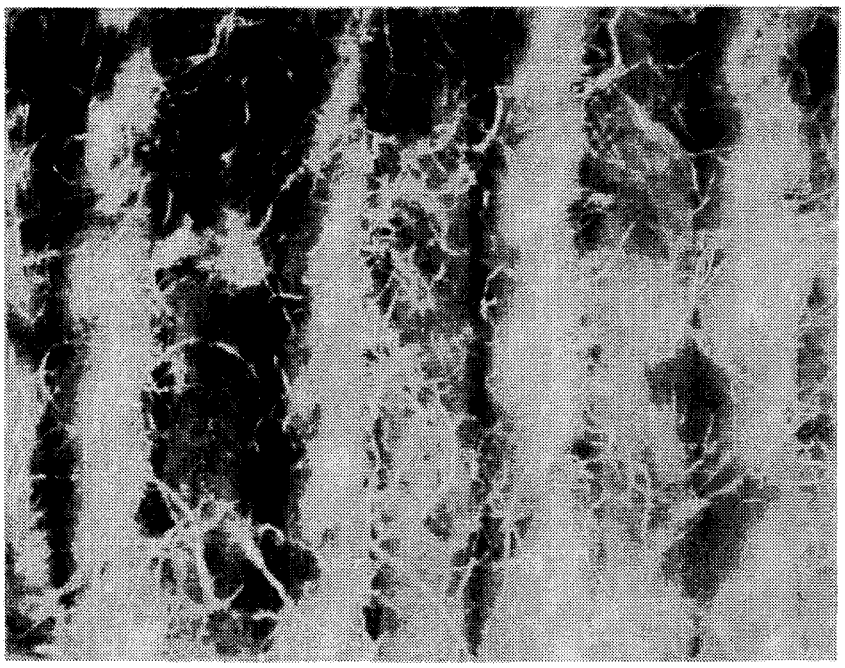
FIG. 9 is a photograph at a magnification of 7.2×, of a typical knit sweater.
Figure 11:
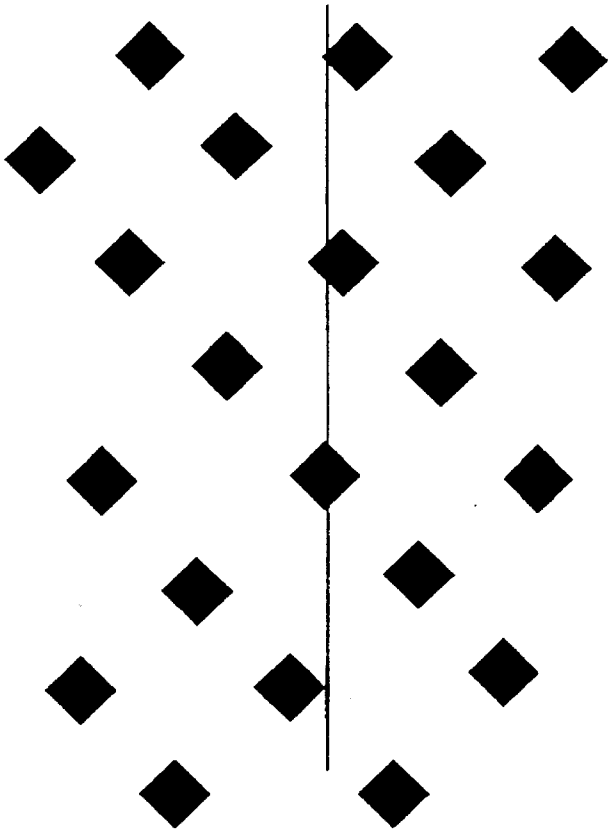
FIGS. 10 and 11 are illustrations of bonding patterns which are not in accordance with the invention.

The bonded, unstretched web is shown in FIG. 7 and the stretched web in FIG. 8. FIG. 9 is a tightly woven knit sweater for comparison purposes. As can be seen, the stretched wire weave bonded fabric also produces the ribs characteristic of a knit.

It can thus be seen from the above examples that a ribbed clothlike nonwoven fabric can be produced by using a bonding pattern as described above and then neckstretching the fabric.

I claim:

1. A ribbed clothlike nonwoven fabric comprising a web of thermoplastic polymer of staple length or longer fibers or filaments having a columnar pattern of fused bonded areas with columns of unbonded area which extend along the fabric;

wherein said bonded and unbonded areas line up substantially regularly through a given length of fabric in columns only;

said pattern has at least one space and at least one unit width in a ratio of at least 0.30, and;

wherein said fabric has been extended up to less than the breaking point of the fibers or filaments in the machine direction, and allowed to relax under low or no tension so as to produce ribs.

2. The fabric of claim 1 wherein said web has been heated to a temperature ranging from greater than said polymer's alpha-transition temperature to about 10 percent below the onset of melting at a liquid fraction of 5 percent, prior to extending said web.

3. The fabric of claim 1 wherein said web has been heated to a temperature ranging from about 66° to about 177° C.

4. The fabric of claim 1 wherein said web has been heated by a method selected from the group consisting of infra-red radiation, steam can, microwave, ultrasonic, flame, hot gas and hot liquid heating.

5. The fabric of claim 1 which is present in items selected from the group consisting of garments, disposable wipes, feminine hygiene products, surgical drapes, industrial wipes, furniture and oil spill cleanup materials.

6. The fabric of claim 1 wherein said thermoplastic polymer is selected from the group consisting of polyolefins, polyamides and polyesters.

7. The fabric of claim 1 wherein said thermoplastic polymer is selected from the group consisting of one or more of polyethylene, polypropylene, polybutene, ethylene copolymers, propylene copolymers and butene copolymers.

8. The fabric of claim 1 wherein said nonwoven fabric has a basis weight of from about 6 to about 400 grams per square meter.

9. A multilayer material comprising at least one layer of the nonwoven fabric according to claim 1 and at least one other layer.

10. A ribbed clothlike nonwoven fabric comprising a web of thermoplastic polymer of staple length or longer fibers or filaments having a columnar pattern of fused bonded areas with columns of unbonded area which extend along the fabric;

wherein said bonded and unbonded areas line up substantially regularly through a given length of fabric;

said pattern has at least one space and at least one unit width in a ratio of at least 0,30, and is selected from the group consisting of the patterns of FIGS. 12 through 17 and;

wherein said fabric has been extended up to less than the breaking point of the fibers or filaments in at least one direction so as to produce ribs.

* * * * *

UNITED STATES PATENT AND TRADEMARK OFFICE

CERTIFICATE OF CORRECTION

PATENT NO. : 5,620,779

DATED : April 15, 1997

INVENTOR(S) : Levy et al.

It is certified that error appears in the above-identified patent and that said Letters Patent is hereby corrected as shown below:

Column 8, Line 51, "0,30," should read -- 0.30, --

Signed and Sealed this

Sixteenth Day of September, 1997

*Attest:*

Bruce Lehman

BRUCE LEHMAN

*Attesting Officer*

*Commissioner of Patents and Trademarks*